US006786589B2

(12) United States Patent
Suzuki et al.

(10) Patent No.: US 6,786,589 B2
(45) Date of Patent: Sep. 7, 2004

(54) INK JET PRINTER, INK JET HEAD, AND IMAGE FORMING METHOD

(75) Inventors: Yoshiyuki Suzuki, Iruma (JP); Yoko Hirai, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/392,534

(22) Filed: Mar. 20, 2003

(65) Prior Publication Data

US 2003/0184632 A1 Oct. 2, 2003

(30) Foreign Application Priority Data

Mar. 27, 2002 (JP) ..... 2002-089325

(51) Int. Cl.[7] ..... B41J 2/01

(52) U.S. Cl. ..... 347/102; 347/101

(58) Field of Search ..... 347/102, 101, 347/100, 104, 96, 95; 101/490, 211, 424.1, 416.1; 400/249; 156/254, 64

(56) References Cited

U.S. PATENT DOCUMENTS

| | | | | | |
|---|---|---|---|---|---|
| 6,234,606 | B1 | * | 5/2001 | Suzuki | 347/100 |
| 6,439,708 | B1 | * | 8/2002 | Kato et al. | 347/100 |
| 6,457,823 | B1 | * | 10/2002 | Cleary et al. | 347/102 |
| 6,598,531 | B2 | * | 7/2003 | Nedblake et al. | 101/490 |
| 2003/0035037 | A1 | * | 2/2003 | Mills et al. | 347/102 |
| 2003/0164870 | A1 | * | 9/2003 | Yamamoto | 347/102 |

* cited by examiner

*Primary Examiner*—Stephen D. Meier
*Assistant Examiner*—Manish Shah
(74) *Attorney, Agent, or Firm*—Frishauf, Holtz, Goodman & Chick, P.C.

(57) ABSTRACT

An ink jet printer for forming an image on a recording medium with an active-ray-setting ink, which is hardened by an irradiation of active rays; having a plurality of heads, each of the plurality of heads having a plurality of jet openings for jetting the active-ray-setting ink as ink drops towards the recording medium; and a plurality of active ray sources of irradiate active rays for hardening the ink drops of the active-ray-setting ink landed on the recording medium, wherein each of the plurality of heads and each of the plurality of active ray sources are arranged alternately.

16 Claims, 9 Drawing Sheets

INK JET PRINTER, INK JET HEAD, AND IMAGE FORMING METHOD

BACKGROUND OF THE INVENTION

This invention relates to an ink jet printer, an ink jet head unit, and an image forming method which makes image formation on a recording medium by the jetting of ink drops on the recording medium.

In recent years, as an image forming method capable of forming an image simply at a low cost, an image forming method using an ink jet printer is used in a large number of cases. A serial type ink jet printer moves a recording medium, a paper sheet for example, intermittently in the sub-scanning direction, and while the recording medium is stopped, moves the head over the recording medium in the main scanning direction which is perpendicular to the sub-scanning direction. Further, during the moving of the head in the main scanning direction, the ink jet printer jets ink drops from the head to the recording medium by deforming a piezoelectric element forming an ink chamber, or by heating a heater in the case where a heater is provided in the ink chamber. In another case, an ink jet printer having a line-shaped head moves a recording medium, a paper sheet for example, in the sub-scanning direction, and jets ink drops from the line-shaped head provided lengthwise in the main scanning direction which is perpendicular to the sub-scanning direction to the recording medium. The methods of jetting ink drops in this case are same as those of serial type ink jet printer. By such operations of ink jet printers, an image is formed on a recording medium.

Incidentally, as regards an ink to be used in an ink jet printer, there is an active-ray-setting ink to be hardened by the irradiation of active rays such as ultraviolet rays or electronic rays. An active-ray-setting ink is composed of, for example, a color material, a polymerizable monomer or oligomer, and a polymerization initiator and a polymerization accelerator at need, and is hardened by a bridging reaction or a polymerization reaction induced by the irradiation of active rays. A printer practicing image formation with such an active-ray-setting ink has been being remarked in recent years from the viewpoint that it gives out comparatively lower smell compared to a printer practicing image formation with a solvent ink and is capable of recording on a recording medium having no ink absorbing ability.

Incidentally, as an ink jet printer making a print with a UV ink to be hardened by ultraviolet rays, such one as shown in FIG. 9 is known. FIG. 9 shows the top view of a state in which a recording medium 104 is being transported in the sub-scanning direction B as an outline view for the purpose of making it easy to understand the layout of the ink jet head. In the ink jet printer shown in FIG. 9, each of the heads 102, 102, - - - jets ink drops of a UV ink to the recording medium 104; the heads 102, 102, - - - are provided on the carriage 101 which is movable back and forth in the main scanning direction A, and a light source 103 is provided at the downstream side of the carriage 101 in the sub-scanning direction B. That is, the light source 103 is provided at the downstream position in the transporting direction B' of the recording medium 104.

This ink jet printer jets ink drops during the moving of the carriage 101 in the main scanning direction A from the heads 102, 102, - - - towards the recording medium 104, transports the recording medium 104 in the direction of the sub-scanning direction B, and makes the light source 103 emit ultraviolet rays. By this operation, ink drops landed on the recording medium 104 are hardened. However, in this ink jet printer, because it takes a considerable time to emit ultraviolet rays after the ink drops are landed on the recording medium 104, the ink drops landed spread to an extent greater than necessary on the recording medium.

Especially, in the case of color printer, where plural heads jet respectively different color ink to form a color image, difference in the degree of color mixture occurs and may lead to a large image problem.

For the purpose of obtaining a high-quality image, it is desirable to irradiate the ink drops by ultraviolet rays to harden the ink drops as soon as possible after the UV ink drops are landed on the recording medium.

Therefore, the object of this invention is to make it possible to form a high-quality image on a recording medium. That is, the object is to accomplish an image formation of high image quality by the controlling of the spreading of ink drops landed on the recording medium as well as by the equalizing of the degree of their spreading.

The above-mentioned object is accomplished by any one of the structures described below.

(1) An ink jet printer for forming an image on a recording medium with an active-ray-setting ink, which is hardened by an irradiation of active rays, comprising: a plurality of heads, each of the plurality of heads having a plurality of jet openings for jetting the active-ray-setting ink as ink drops towards the recording medium; and a plurality of active ray sources to irradiate active rays for hardening the ink drops of the active-ray-setting ink landed on the recording medium, wherein each of the plurality of heads and each of the plurality of active ray sources are arranged alternately.

According to the structure (1), because each of the plural heads and each of the plural active ray sources are arranged alternately, the ink drops landed on a recording medium, from whichever heads they have been jetted, are immediately irradiated by the active rays emitted from the neighboring active ray source. Hence, any ink drop jetted from any one of the heads starts setting by the irradiation of the active rays within a specified range of time after landing on the recording medium; therefore, ink drops do not spread on the recording medium, and what is called a blur is prevented. Further, because the time interval from the landing of an ink drop to the irradiation by active rays does not vary from an ink drop from one head to that from another, the dispersion of the blur among the heads can be suppressed. Thus, a high-quality image can be obtained.

(2) An ink jet printer as set forth in the structure (1) further comprising a mobile body being movable in the main scanning direction relatively to a recording medium and having the aforesaid plural heads and the aforesaid plural active ray sources arranged alternately in said main scanning direction.

According to the structure (2), because the plural heads and the plural active ray sources are provided in the mobile body being movable in the main scanning direction relatively to a recording medium, this structure can be applied to an ink jet printer having a mechanism such that the printer jets ink drops to a recording medium while it moves the heads in the main scanning direction. This structure can provide a serial type ink jet printer.

(3) An ink jet printer as set forth in the structure (2), wherein the aforesaid plural jet openings are formed linearly along the sub-scanning direction which is substantially perpendicular to the aforesaid main scanning direction.

According to the structure (3), because the plural jet openings are formed linearly along the sub-scanning direction, compared to a conventional technology shown in FIG. 9, the time interval from the landing of an ink drop on a recording medium to the irradiation by active rays becomes shorter. Thus, the spreading of ink drops is reduced.

(4) The ink jet printer of the structure (2), wherein the intervals between each of the plurality of heads and each of the active ray sources neighboring to said each of the plurality of heads become equal to one another.

According to the structure (4), since the intervals between each of the plurality of heads and each of the active ray sources neighboring to said each of the plurality of heads become equal to one another, any one of ink drops jetted from any one of the heads has approximately a definite time interval from the landing on a recording medium to the irradiation by active rays. And all the ink drops have approximately a definite degree of spreading on the recording medium; thus a higher image quality can be obtained.

(5) An ink jet printer as set forth in the structure (2), wherein the aforesaid plural active ray sources are arranged in such a way that the intervals between two neighboring active ray sources become equal to one another, the aforesaid plural heads are arranged in such a way that the intervals between two neighboring heads become equal to one another, and the aforesaid mobile body is controlled so as to move at a constant speed in the range of image formation.

According to the structure (5), because the intervals between two neighboring active ray sources and the intervals between two neighboring heads both fall within a specified distance, and the mobile body moves at a constant speed in the range of image formation, any one of ink drops jetted from any one of the heads has approximately a definite time interval from the landing on a recording medium to the irradiation by active rays. Thus, although there is a little difference depending on the position of the jet openings of the heads, the time required for hardening becomes equalized approximately, and all the ink drops have approximately a definite degree of spreading on the recording medium; thus a higher image quality can be obtained.

(6) An ink jet printer as set forth in the structure (2), wherein said ink jet printer is controlled so as to jet ink drops from the aforesaid jet openings and emit the aforesaid active rays during the movement of the aforesaid mobile body.

According to the structure (6), an ink drop landed on a recording medium is irradiated by active rays from an active ray source immediately after the landing. Hence, the ink drop does not spread on the recording medium, and what is called a blur is prevented; thus, a high-quality image can be obtained.

(7) An ink jet printer as set forth in the structure (1), wherein the aforesaid plural heads and the aforesaid plural active ray sources are alternately arranged in the sub-scanning direction relatively to a recording medium.

According to the structure (7), this invention can be applied to an ink jet printer having a head of the same length as the length in the main scanning direction of a recording medium, what is called a line head.

(8) An ink jet printer as set forth in the structure (7), wherein the aforesaid plural jet openings are formed linearly along the main scanning direction which is substantially perpendicular to the aforesaid sub-scanning direction.

According to the structure (8), because the plural jet openings are formed linearly along the main scanning direction, in an ink jet printer using what is called a line head, the time interval from the landing of an ink drop to the irradiation by active rays becomes short. Thus, the spreading of ink drops is reduced.

(9) The ink jet printer of the structure (7), wherein the intervals between each of the plurality of heads and each of the active ray sources neighboring to said each of the plurality of heads become equal to one another.

According to the structure (9), since the intervals between each of the plurality of heads and each of the active ray sources neighboring to said each of the plurality of heads become equal to one another, any one of ink drops jetted from any one of the heads has approximately a definite time interval from the landing on a recording medium to the irradiation by active rays. And all the ink drops have approximately a definite degree of spreading on the recording medium; thus a higher image quality can be obtained.

(10) An ink jet printer as set forth in the structure (7), wherein the aforesaid plural active ray sources are arranged to have equal intervals between two neighboring active ray sources, and the aforesaid plural heads are arranged to have equal intervals between two neighboring heads.

According to the structure (10), because the intervals between two neighboring active ray sources and the intervals between two neighboring heads both fall within a specified distance, for an ink drop jetted from any one of the heads of what is called a line head type, the time interval from the landing of an ink drop on a recording medium to the irradiation by active rays becomes approximately constant. Thus, the time required for hardening is made approximately equalized, and any ink drop has approximately a definite degree of spreading on a recording medium; thus, a higher image quality can be obtained.

(11) An ink jet printer as set forth in the structure (1), wherein the time interval from the landing of an ink drop which is jetted from any one of the aforesaid plural heads to the irradiation by active rays emitted at first by any one of the aforesaid active ray sources, from whichever head the ink drop is jetted, falls within a specified range of time.

According to the structure (11), for ink drops, from whichever head they are jetted, because the dispersion of the time up to the irradiation by active rays becomes small, the degree of spreading of the ink drops on a recording medium becomes approximately equal to one another, and the degree of what is called a blur becomes approximately constant; thus, a high-quality image can be obtained.

(12) The ink jet printer of the structure (1), further comprising a transporting mechanism for transporting the recording medium in a sub-scanning direction.

According to the structure (12), it becomes possible to form an image on the recording medium by transporting the recording medium.

(13) The ink jet printer of the structure (1), wherein the plurality of heads are heads for forming a full color image.

According to the structure (13), since unevenness and blur of each color ink can be prevented in the course of color image forming, a high quality full color image without undesired color mixing can be obtained.

(14) An ink jet printer for forming an image on a recording medium with an active-ray-setting ink which is hardened by the irradiation of the active rays comprising a mobile body being movable in the main scanning direction relatively to a recording medium, an active ray source provided on said mobile body for applying said active rays to a recording medium, and a plurality of lines of jet openings, each line having a plurality of jet openings, arranged at both the sides of said active ray source in said main scanning direction for jetting said active-ray-setting ink as ink drops towards a recording medium.

According to the structure (14), because a line of jet openings is arranged at each of both sides of the active ray source, in the case when this invention is applied to an ink jet printer of a type such that the printer jets ink drops at the time of moving forward and at the time of moving backward, for an ink drop jetted at either of both the times, hardening begins by the irradiation of active rays within a specified range of time after the landing. Hence, independently of the time of jetting, the spreading of ink drops on a recording medium can be suppressed, and what is called a blur can be prevented; thus, a high-quality image can be obtained.

(15) An ink jet head comprising: a plurality of lines of jet openings, each line having a plurality of jet openings, arranged linearly on different lines respectively for jetting an active-ray-setting ink which is hardened by the irradiation of active rays as ink drops, and an active ray source provided between said plurality of lines of jet openings for emitting active rays.

According to the structure (15), if this ink jet head is applied to an ink jet printer, because an ink drop landed on a recording medium is irradiated by active rays immediately after the landing, a high-quality image can be obtained.

(16) An image forming method for forming an image on a recording medium with an active-ray-setting ink, which is hardened by an irradiation of active rays, comprising:

jetting the active-ray-setting ink as ink drops from a plurality of heads towards the recording medium; and irradiating ink drops landed on the recording medium with the active rays, after the jetting process, wherein the time interval after an ink drop is landed on the recording medium by the jetting process up to the time the ink drop is irradiated by the active rays in the irradiating process is approximately the same for the ink drop jetted from any of the plurality of heads.

According to the structure (16), since the intervals between each of the plurality of heads and each of the active ray sources neighboring to said each of the plurality of heads become equal to one another, any one of ink drops jetted from any one of the heads has approximately a definite time interval from the landing on a recording medium to the irradiation by active rays. And all the ink drops have approximately a definite degree of spreading on the recording medium; thus a higher image quality can be obtained.

(17) The image forming method of the structure (16), wherein the time interval after an ink drop is landed on the recording medium by the jetting process up to the time the ink drop is irradiated by the active rays in the irradiating process is controlled to become 0.001 second to 0.4 second for the ink drop jetted from any of the plurality of heads.

According to the structure (17), because an ink drop landed on a recording medium is immediately irradiated by active rays, the spreading of ink drops on a recording medium can be suppressed, and the blur of ink can be prevented. Hence, a high-quality image can be obtained.

(18) The image forming method of the structure (17), wherein the time interval after an ink drop is landed on the recording medium by the jetting process up to the time the ink drop is irradiated by the active rays in the irradiating process is controlled to become 0.005 second to 0.2 second for the ink drop jetted from any of the plurality of heads.

According to the structure (18), because the spreading of ink drops on a recording medium can be suppressed more sufficiently, the blur of ink can be better prevented. Hence, a higher-quality image can be obtained. On the other hand, because the allowance for the lower limit value is broadened, the degree of freedom in an image forming process is made greater.

Further, the above-mentioned object can be accomplished by any one of the structures shown below.

(101) An ink jet printer for forming an image on a recording medium by jetting active-ray-setting ink drops to be hardened by the irradiation of active rays to a recording medium, comprising a mobile body being movable in the main scanning direction relatively to a recording medium, one or a plurality of heads provided on said mobile body having a plurality of jet openings for jetting an active-ray-setting ink as ink drops towards a recording medium, and one or a plurality of active ray sources for emitting active rays towards a recording medium, characterized by said active ray sources being arranged alternately with said heads in the main scanning direction.

According to the structure (101), one or a plurality of heads are provided on a mobile body, and from the jet openings of each head, ink drops of an active-ray-setting ink are jetted. Because a plurality of active ray sources are arranged alternately for the heads with respect to the main scanning direction, an ink drop landed on a recording medium, from a jet opening of whichever head it has been jetted, accompanied by the movement of the mobile body, is immediately irradiated by active rays from the active ray source adjacent to the head of jetting source. Hence, an ink drop jetted from a jet opening of any one of the heads is irradiated by active rays within a specified range of time after it is landed on a recording medium, to start to be hardened; therefore, ink drops do not spread on a recording medium, and what is called a blur can be prevented. Thus, this invention exhibits an effect to make it possible to obtain a high-quality image.

Further, because a plurality of active ray sources and a plurality of heads are alternately arranged in the main scanning direction, the time interval after an ink drop jetted from one head is landed on a recording medium up to the time it is irradiated by the active rays from the neighboring active ray source is approximately equal to the time interval after an ink drop jetted from another head is landed on the recording medium up to the time it is irradiated by active rays from the neighboring active ray source. Further, compared to a conventional example shown in FIG. 9, because the time interval from the landing of an ink drop up to the irradiation by active rays becomes shorter, the blur of ink drops is reduced. Hence, this invention exhibits an effect to make it possible to obtain a higher-quality image.

In addition, the term "head" stands for a combination of jet openings (a group of jet openings) having a plurality of them.

(102) An ink jet printer as set forth in the structure (101), characterized by the aforesaid jet openings being formed linearly along the sub-scanning direction which is substantially perpendicular to the aforesaid main scanning direction in the aforesaid one or a plurality of heads.

In the structure (102), because a plurality of jet openings arranged linearly along the sub-scanning direction in a head, compared to a conventional one shown in FIG. 9, the time interval from the landing of an ink drop up to the irradiation by active rays becomes shorter; therefore, the blur of ink drops is reduced. Further, the length of the head in the main scanning direction is reduced shorter than the structure (1), the blur of ink drops is more reduced. Hence, this invention exhibits an effect to make it possible to obtain a higher-quality image.

(103), An ink jet printer as set forth in the structure (101) or (102) characterized by it that the intervals between neighboring two of the aforesaid active ray sources are all equal to one another, and the intervals between neighboring two of the aforesaid heads are all equal to one another, and the aforesaid mobile body moves at a constant speed in the image formation range.

According to the structure (103), the intervals between two neighboring active ray sources are all equal to one another, and the intervals between two neighboring heads are all equal to one another, the distance from one to the other of any combination of an active ray source and a head neighboring to each other falls within a specified range, and the mobile body moves at a constant speed; therefore, for jetted ink drops, from whichever jet opening they are jetted, the time interval from the landing to the irradiation is approximately constant. Hence, landed ink drops, from whichever head they are jetted, have approximately the same degree of spreading. Further, compared to the conventional example shown in FIG. 9, for an ink drop, the time interval from the landing to the irradiation by active rays becomes shorter; therefore, the blur of the ink drop is reduced. Further, the length of the heads in the main scanning direction becomes shorter than that of the structure (101), the blur of ink drops is more reduced. Hence, this invention exhibits an effect to make it possible to obtain a higher-quality image.

(104) An ink jet printer as set forth in the structure (101), characterized by it that the time interval from the landing of an ink drop jetted from a head on a recording medium to the irradiation by the active rays emitted from the neighboring active ray source located at the rear side in the direction of said head moving in the main scanning direction with the movement of the aforesaid mobile body falls within a range of time for a jet opening of any head.

In the structure (104), compared to the conventional example shown in FIG. 9, for an ink drop, the time interval from the landing to the irradiation by active rays becomes shorter; therefore, the blur of the ink drop is reduced. Further, the length of the heads in the main scanning direction becomes shorter than that of the structure (101), the blur of ink drops is more reduced. Hence, this invention exhibits an effect to make it possible to obtain a higher-quality image.

(105) An ink jet printer as set forth in any one of the structures (101) to (104), characterized by it that an image is formed in such a way that ink drops are jetted from the aforesaid jet openings during the movement of the aforesaid mobile body.

In the structure (105), because ink drops are jetted from the jet openings during the movement of the mobile body, the ink drops landed on a recording medium are irradiated by the active rays from the active ray source immediately after the jetting. Hence, the ink drops do not spread on the recording medium, and what is called a blur is prevented. Thus, this invention exhibits an effect to make it possible to obtain a high-quality image.

(106) An ink jet printer for forming an image on a recording medium by jetting active-ray-setting ink drops to be hardened by the irradiation of active rays to a recording medium, characterized by it that an active ray source for applying active rays for setting to ink drops is provided on a mobile body to be moved in the main scanning direction relatively to a recording medium, and a line of jet openings for jetting an active-ray-setting ink as ink drops towards a recording medium is provided at either of the sides of said active ray source.

In the structure (106), because a line of jet openings is provided at either of the sides of the active ray source, an ink drop, from a jet opening of whichever head it is jetted, is immediately irradiated by the active rays from the active ray source, accompanied by the movement of the mobile body. Hence, an ink drop jetted from a jet opening of any head is irradiated by active rays within a specified range of time after it is landed on a recording medium to start setting; therefore, ink drops do not spread on the recording medium, and what is called a blur is prevented. Thus, this invention exhibits an effect to make it possible to obtain a high-quality image.

(107) An ink jet head comprising jet openings arranged linearly for jetting an active-ray-setting ink to be hardened by the irradiation of active rays as ink drops towards a recording medium, and an active ray source for emitting active rays towards a recording medium, characterized by it that as regards said jet openings linearly arranged, a plurality of them are formed, and said active ray source is disposed between a line of said jet openings and the neighboring one.

In the structure (107), because an active ray source is disposed between a line of said jet openings and the neighboring one, ink drops jetted are irradiated immediately after the landing on a recording medium by the active rays from the active ray source. Thus, this invention exhibits an effect to make it possible to obtain a high-quality image.

(108) An image forming method comprising a jetting process for jetting active-ray-setting ink drops to be hardened by the irradiation of active rays as ink drops to a recording medium, and an irradiation process for irradiating ink drops landed on a recording medium by active rays, characterized by the time interval from the jetting of an ink drop to the irradiation being controlled so as to fall within a range of 0.0001 second to 0.4 second.

(109) An image forming method as set forth in the structure (108), characterized by the time interval from the jetting of an ink drop to the irradiation being controlled desirably so as to fall within a range of 0.0005 second to 0.2 second.

DETAILED DESCRIPTION OF THE PREFERRED EMBODIMENT

Figure 1:
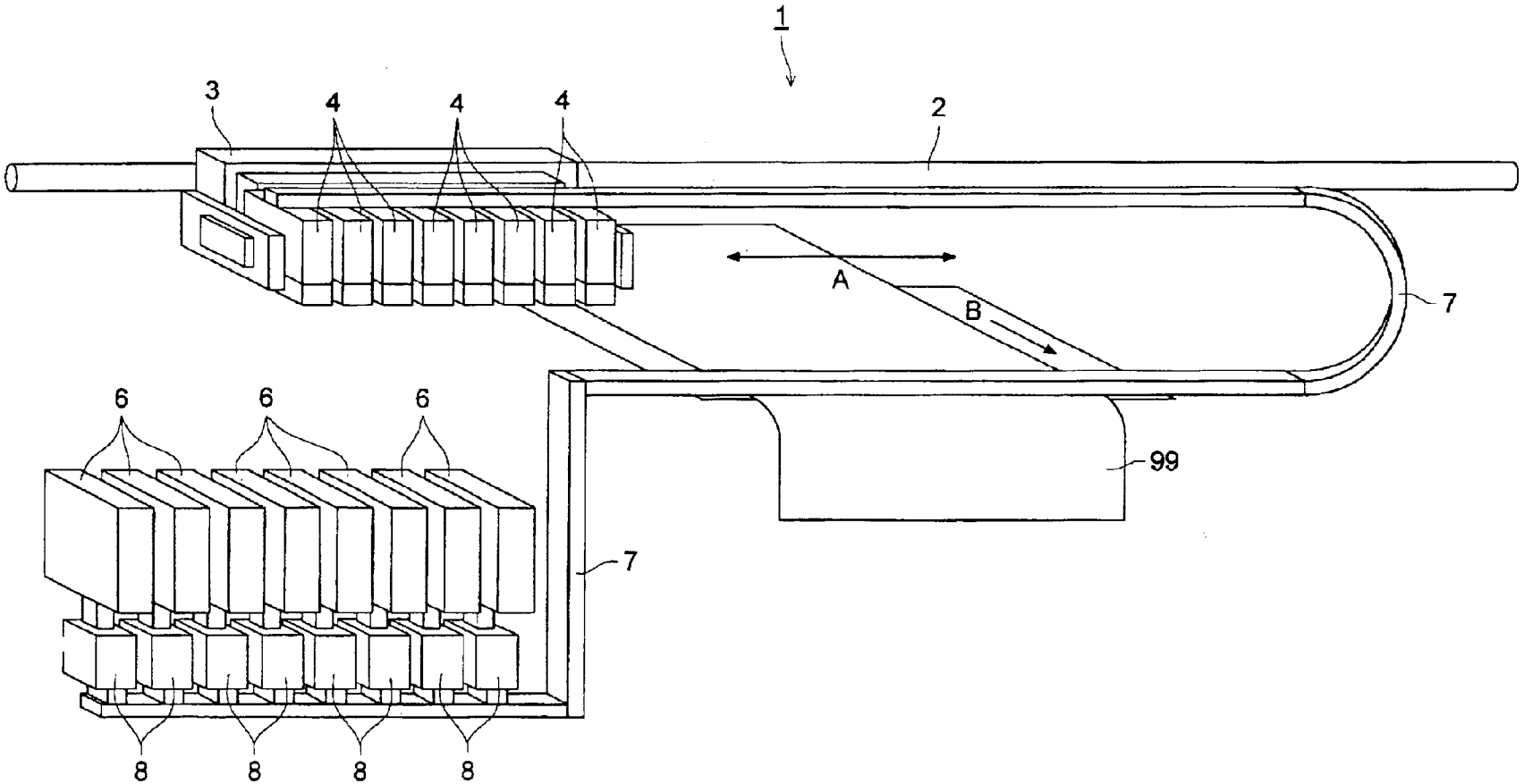
FIG. 1 is a perspective view showing the essential part of an ink jet printer to which this invention is applied.

In the following, concerning this invention, the concrete modes will be explained with reference to the drawings. However, the scope of the invention is not to be limited to the examples shown in the drawings.

In FIG. 1, a serial type ink jet printer 1 is shown.

The ink jet printer 1 jets a UV ink (an ultraviolet-ray-setting ink) having a nature to be hardened by the irradiation of ultraviolet rays as drops (hereinafter referred to as "ink drops") towards a recording medium 99, and carries out an ultraviolet ray irradiation after the landing of the ink drops, to practice an image formation on the recording medium 99. In the explanation to be given below, a UV ink is adopted for an active-ray-setting ink; however, it is also appropriate to use an ink having a nature to be activated and hardened by active rays such as infrared rays, visible rays, electron rays, and X-rays. The above-mentioned active rays means active rays in a broad sense. That is, active rays taken in this specification means not only ones having a capability of ionizing air but also electromagnetic waves such as ultraviolet rays, visible rays, and infrared rays. In short, active rays are such as to activate and harden an ink. Further, for the material of the recording medium 99, resin, paper, or some other material on which an image can be formed by the printer 1 can be appropriately used.

The ink jet printer 1 is equipped with a flat board platen and a transport mechanism (not shown) for transporting a sheet-shaped recording medium 99 in the sub-scanning direction B, a guide member 2 disposed lengthwise in the main scanning direction A which is approximately perpendicular to the sub-scanning direction B, a carriage 3 which is a mobile body to be moved in the main scanning direction A along the guide member 2 guided by the guide member 2, a plurality of ink jet heads mounted on the carriage 3 (hereinafter referred to as "heads" simply) 4, 4, - - - for jetting ink drops of UV inks, a plurality of UV light sources (active lay sources) 5, 5, - - - (shown in FIG. 2, etc.) for emitting ultraviolet rays, a plurality of ink tanks 6, 6, - - - arranged under the carriage 3 for storing the UV inks, an ink supply paths 7 for supplying the UV inks from the ink tanks 6 to the heads 4, pressure varying pumps 8 provided respectively at the ink tanks 6, etc.

The above-mentioned transport mechanism has a function to transport the recording medium 99 in the transporting direction (reverse to the sub-scanning direction) in accordance with the operation of the carriage 3; to state it concretely, a function to transport the recording medium intermittently, that is, also a function to repeat the stop and transport of the recording medium 99.

As the recording medium 99, one composed of a material usually used for an ordinary ink-jet printer such as various kinds of paper, clothe and unwoven fabric, resin, metal and glass can be applied. The recording medium may be used in a form of a roll, a cut sheet or a plate.

Transparent or opaque non-absorbent resin film usually used for soft packaging is preferably applied for the recording medium 99 to be used in the embodiment of the invention. Concrete examples of the resin usable for the resin film include poly(ethylene terephthalate), polyester, polyolefin, polyamide, polyesteramide, polyether, polyimide, polyamideimide, polystyrene, polycarbonate, poly-□-phenylene sulfide, poly(ether ester), polyvinyl chloride, poly(metha)acrylate, polyethylene, polypropylene and nylon. Moreover, a copolymer, mixture and cross-linked substance of such the resins are also usable. Among them, a stretched poly(ethylene terephthalate) film, a polystyrene film, a polypropylene film and a nylon film are preferable from the viewpoint of the transparency, the dimension stability, the stiffness, the environmental loads and the cost. The resin film with a thickness of from 2 $\mu$m to 100 $\mu$m is preferably used. The use of the resin film with a thickness of from 6 $\mu$m to 50 $\mu$m, is more preferable. A surface treatment such as a corona discharge treatment or an adhesiveness increasing treatment may be applied to the surface of the resin film.

Known opaque recording media such as various kinds of paper coated with resin, a film containing a pigment and a foamed film are further usable.

The carriage 3 moves back and forth in the main scanning direction A along the guide member 2 in accordance with the intermittent transport by the transporting mechanism of the recording medium 99; to state it concretely, it moves forward, moves backward, or moves forward and backward in the main scanning direction A while the recording medium is stopped. Further, the carriage 3 moves at an approximately constant speed in the image formation range (that is, directly above the recording medium 99), while it moves out of the image formation range up to the end of the movement range (in other words, the turning end), it moves in a decelerated way, and while it moves, after turning at the turning end, up to the image formation range, it moves in an accelerated way. For example, in the case of the example of FIG. 1, the carriage 3 moves in an accelerated way from the left end of the movement range to the directly upside position of the recording medium 99, it moves at a constant speed from left to right directly above the recording medium 99, it moves in a decelerated way from the end position of the range directly above the recording medium 99 to the right end position, it moves in an accelerated way after it turns at the right end and until it is positioned directly above the recording medium 99, it moves at a constant speed from right to left directly above the recording medium, and it moves in a decelerated way after it comes out of the range directly above the recording medium 99 until it is positioned at the left end of the movement range.

In the carriage 3, there are provided a plurality of heads 4, 4, - - - . Inside the heads 4, there is provided a jetting means (drawing is omitted) such as a piezoelectric element. The head 4 jets ink drops from the jet openings (to be described in detail later) by the action of the jetting means. For the colors of the inks to be used in the ink jet printer 1, yellow (T), magenta (M), cyan (C), and black (K) are used as the basic ones, and in addition to these, white (W), light yellow (LY), light magenta (LM), light cyan (LC), light black (LB), etc. are used. Further, it is also allowed to use special colors such as blue, red, green, gold, and silver for the UV inks to be used in the ink jet printer 1. From one of the heads 4, UV ink drops having one of these colors are jetted. Further, basically ink drops of the UV inks of different colors for the respective heads 4 are jetted, but it is also possible to jet ink drops of the UV inks of the same color from two or more heads 4.

The ink tanks 6, 6, - - - are cartridges which are able to be replaced, and in each of the ink tanks 6, an UV ink of one of the colors is stored. In other words, in each of the ink tanks 6, a UV ink of some one color among the several kinds of color is stored. Basically, UV inks of different colors are stored in the respective ink tanks 6, but it is also possible that UV inks of the same color are stored in two or more ink tanks 6. Besides, each of the UV inks stored in each UV tank 6 is composed of the pigment corresponding to the color, and on top of it, a monomer (an oligomer), photochemical reaction initiator, etc., and has a property to set by the bridging and polymerization reaction of the monomer caused by the action of the photochemical reaction initiator as a catalyst irradiated by ultraviolet rays.

As the ink to be charged into these ink tanks 6, 6 . . . , a material is usable which is suiting to "the hardening system utilizing an acid/base photo-generating agent" or "the photo-induction type alternately polymerization" each described in the first and second paragraphs, respectively, of "the photo hardening system" in Section 4 of "Photo hardening technology—Selection of Resin Initiator, Mixing Condition and Measurement and Evaluation of Hardened Degree", Technological Association Information. A material to be hardened by radical polymerization or cationic polymerization may also be used.

In concrete, the UV ink to be used in the embodiment of the invention is an ink hardenable by irradiation of ultraviolet rays as the active rays. The ink contains at least a pigment or colorant of the required color, a polymerizable compound so usually called as a monomer including a known polymerizable compound and a photo reaction initiator as the principal components. The UV ink having such the composition is hardened by the cross linking or polymerization reaction of the monomer caused by the effect of the photo reaction initiator when the initiator is irradiated by UV rays. When the ink suiting "the photo inducing type alternative polymerization" is used, the photo reaction initiator may be omitted.

The ultraviolet ray hardenable ink is roughly classified into a radical hardenable ink containing a radical polymerizable compound and a cationic hardenable ink containing a cationic polymerizable compound. Both of the types of the ink can be applied to the embodiment of the invention. A hybrid type ink in which the radical hardenable ink and the cationic hardenable in are combined may also be applied to the embodiment of the invention.

However, the cationic hardenable ink is particularly used in the embodiment of the invention since the cationic hardenable ink is superior in the function and the wide usability, which is difficultly incurred the polymerization hindrance by oxygen. The cationic hardenable ink to be used in the embodiment of the invention is a mixture of at least a cationic polymerizable compound such as an oxetane compound, an epoxy compound, a vinyl ether compound and a vinyl ether compound, a photo reaction initiator and a colorant, which is hardened by the irradiation of ultraviolet rays.

The ink supply paths 7 lead from the ink tanks 6, 6, - - - to the heads 4, 4, - - - for the respective colors, and through the ink paths 7, UV inks of the respective colors are supplied from the ink tanks 6 to the heads 4 connected to the corresponding ink tanks 6. In other words, the color of a UV ink stored in any one of the ink tanks 6 is the same as the ink drops jetted from the heads 4 leading to the ink tank 6 through the ink supply path 7. Further, the ink supply paths 7 are formed of a flexible material in order to be able to comply with the movement of the carriage 3.

Further, in the ink supply paths 7, there are provided a plurality of pressure varying pumps 8, 8, - - - . By the changing of the internal pressure of the ink supply path 7 which leads from the ink tank 6 to the head 4 caused by the pressure varying pump 8, the amount of ink supply from the ink tank 6 to the head is changed.

Now, the carriage 3 will be explained in detail.

Figure 2:
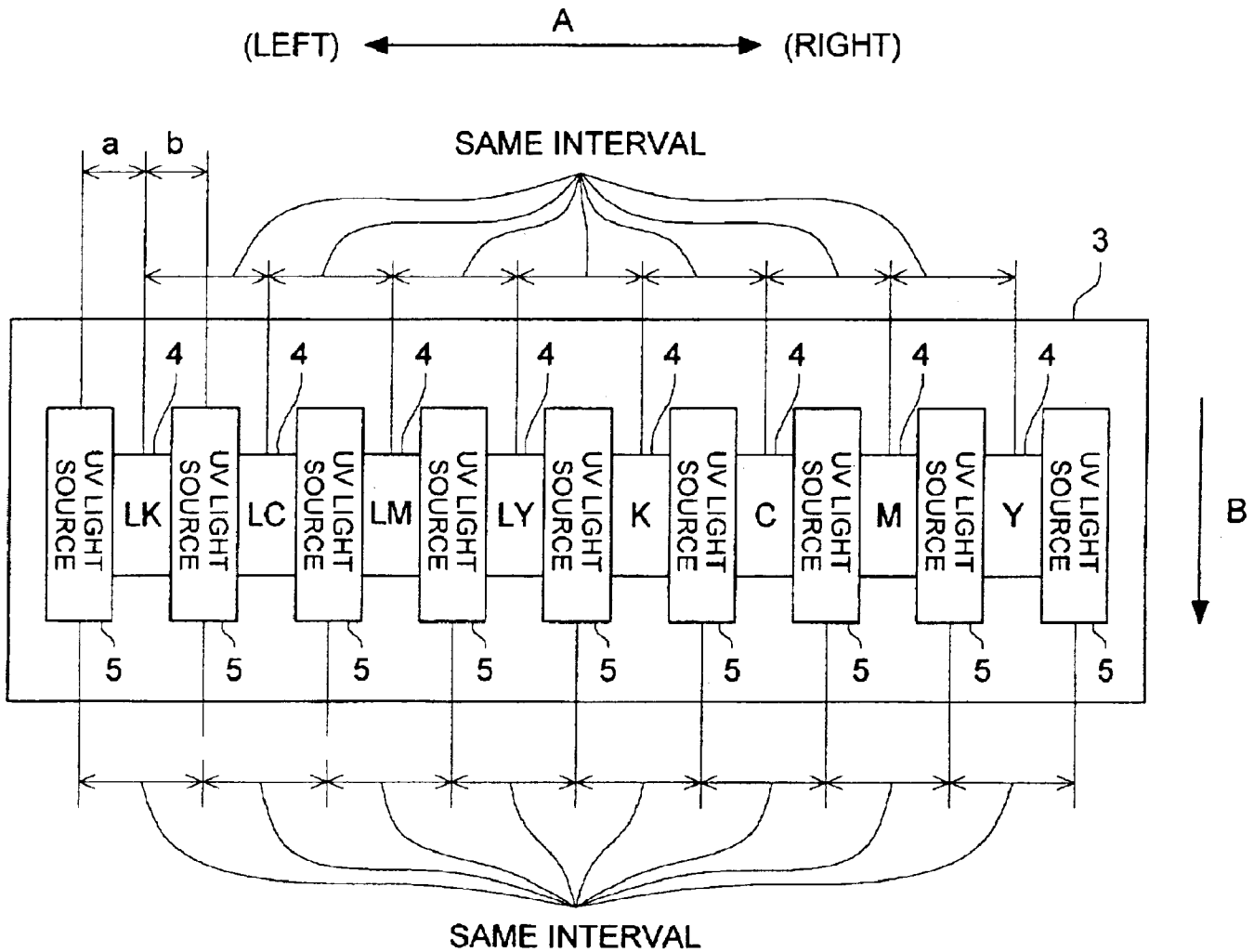
FIG. 2 is the bottom view showing as an outline a carriage provided in the above-mentioned ink jet printer.

In FIG. 2, the bottom view of the carriage 3 is shown. As shown in FIG. 2, on the carriage 3, there are provided the heads 4, 4, - - - as described in the above, and on top of these, the UV light sources 5, 5, - - - are also provided. The heads 4, 4, - - - are arranged in a line at equal intervals in the main scanning direction. That is, the straight line connecting the heads 4, 4, - - - is parallel to the main scanning direction A, and the intervals between two neighboring heads 4 are all the same. Also the UV light sources 5, 5, - - - are arranged in a line in the main scanning direction A at equal intervals. Further, between two UU light sources 5 and 5, one head 4 is located; thus, the heads 4 and the UV light sources 5 are arranged alternately in the main scanning direction A. In other words, at each of both the sides of any one of the UV light sources, one head 4 is disposed.

In a line composed of these heads 4, 4, - - - and UV light sources 5, 5, - - - , in order to apply UV rays to all ink drops regardless of the moving direction of the carriage 3, at both the ends in the main scanning direction A, one UV light source is located. Further, the distance between one of the heads 4 and its one neighboring UV light source "a" may be unequal to the distance between the heads and the other neighboring UV light source "b", but the distance "a" should desirably be equal to the distance "b". In the case where the distance "a" and the distance "b" are equal to each other, it can be said that the heads 4 and the UV light sources 5 are arrayed alternately and at equal intervals in a straight line. In addition, the basic point in the heads 4 (the reference point for representing the distances "a" and "b") is defined to be the position of the jet openings, or in the case of plural lines of jet openings, the central position of those lines of jet openings with respect to the main scanning direction A. Besides, in FIG. 2, the signs attached to the heads 4 stands for the respective colors of ink drops to be jetted, but the arrangement of the colors is not limited to the example shown in FIG. 2.

Now, the head 4 and the UV light source 5 will be explained in detail.

Figure 3:
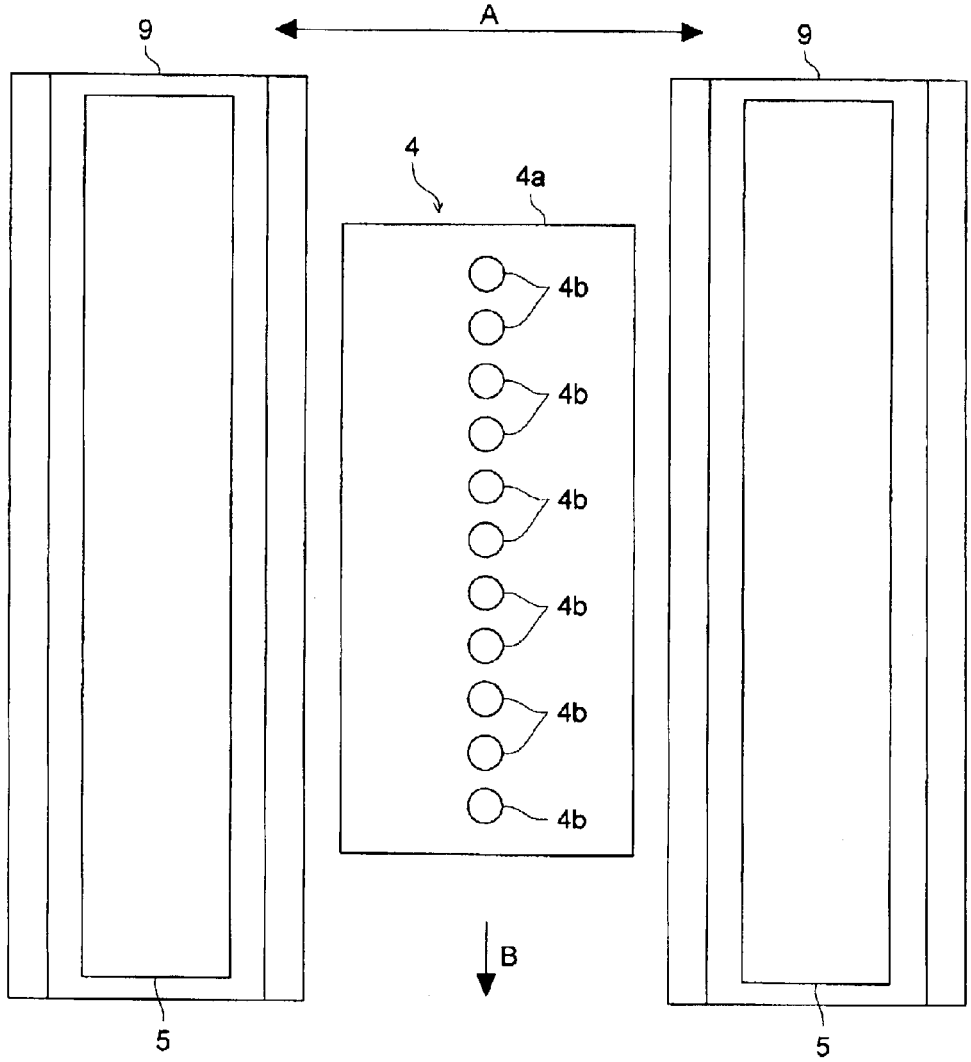
FIGS. 3(*a*) and 3(*b*) are drawings showing as an outline a head provided in the above-mentioned carriage and light sources arranged at both the sides respectively.
Figure 3:
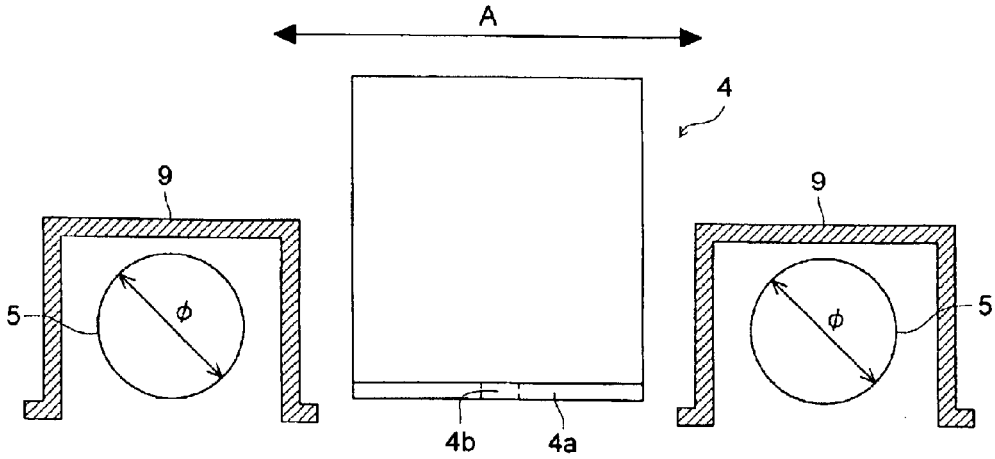

In FIG. 3(*a*), the bottom view of one head 4 and two UV light sources 5 and 5 arranged at both the neighboring positions, and in FIG. 3(*b*), the front view of this head 4 and these UV light sources 5 and 5 as seen in the sub-scanning direction B.

As shown in FIG. 3, in each head 4, there is provided a nozzle plate 4*a* to make up the bottom of this head 4. In the nozzle plate 4*a*, a plurality of jet openings 4*b*, 4*b*, - - - leading from the internal space of the head 4 to its outside are formed. The jet openings 4*b*, 4*b*, - - - are arrayed in a straight line in the sub-scanning direction B. By the action of a jetting means such as a piezoelectric element of each jet opening 4*b*, an ink drop from said jet opening 4*b* is supposed to be jetted. Further, to the internal space of the head 4, a UV ink is supplied from the ink tank 6, and it is needless to say that the color of the ink drops jetted from the respective jet openings are all the same, because this internal space is common to all jet openings 4*b*, 4*b*, - - - .

The UV light source 5 is made up of a UV ray lamp for emitting ultraviolet rays in a specified wavelength region (for example, a wavelength of 250 nm) with a stabilized energy, etc. The wavelength of the ultraviolet rays emitted from the UV light source 5 and the irradiation strength are suitably determined in accordance with the material of the recording medium 99 and the kind of the UV ink; for example, it is possible to determine the emission strength to be 100 mW/cm$^2$ [or 100 mJ/cm$^2$]. For the ultraviolet ray lamp, an LED (a Light Emitting Diode), a fluorescent lamp, a high-pressure mercury lamp, a metal halide lamp, a high-pressure mercury spot lamp, a xenon lamp, etc. can be used.

Further, in order not to expose the head 4 to the ultraviolet rays emitted from the UV light source 5, the UV light source 5 is covered with a shading cover 9 over the upper side. On the other hand, the recording medium 99 is exposed to the ultraviolet rays emitted from the UV light source 5. The length of the UV light source 5 in the sub-scanning direction B is longer than or approximately equal to the length of the head 4 in the sub-scanning direction B (the total width covering the plural jet openings 4*b*, 4*b*, - - - ). Further, in this example of the embodiment, the diameter ϕ of the UV light source 5 is 5 mm, but it is not necessary to make it 5 mm. In addition, as regards the UV light source 5, it is possible to change the wavelength of the ultraviolet rays to be emitted and the emission energy in accordance with the material of the recording medium 99 and the kind of the UV ink.

Further, in this example of the embodiment, the UV light source 5 itself is disposed at the side of the head 4 as shown in FIG. 3, but in the case where ultraviolet rays are applied through a light conductor such as an optical fiber, it is unnecessary to move what is called "a light source (light emission unit)" itself in parallel with the head 4 as a united body. In this case, the term "an active light source" used in this invention represents the end portion of the optical fiber provided at the carriage 3 to be movable in parallel with the head 4 as a united body; the ultraviolet rays from what is called "a light source" provided apart from the carriage 3 is conducted through the optical fiber, and irradiates the downward area from between the heads 4 and 4. Hence, the end portions of the optical fibers as seen from the lower side are arranged like the UV sources, as shown in FIG. 2.

Next, the operation of the ink jet printer 1 having a structure as described in the above, and an image formation method by the ink jet printer 1 will be explained.

During the operation of the ink jet printer 1, ultraviolet rays are emitted from the UV light source 5, and the recording medium 99 is irradiated by the ultraviolet rays. Further, the ink jet printer 1 transports the recording medium intermittently in the sub-scanning direction B. Now, while the recording medium 99 is stopped, the carriage 3 moves at least forward in the main scanning direction A, or moves backward also, and it makes a constant-speed movement in the image formation range, that is, in the range directly above the recording medium 99. Then, during the movement of the carriage 3 in the image formation range, each head 4 jets ink drops from the jet openings 4*b*, 4*b*, - - - , and the jetted ink drops are landed on the recording medium 99. The landed ink drops are hardened by the irradiation of the ultraviolet rays emitted from the UV light source 5 located at the rear side of the head 4 moving in the main scanning direction.

In the case of that the ink droplet is ejected onto the non-absorbent plastic film such as poly(ethylene terephthalate) film, the ink droplet is largely spread and the image quality is lowered when the ink is stood for an excessive duration in the unhardened state after landing the ink droplet onto the film. For obtaining a uniform and high quality image, it is preferred to irradiate ultraviolet rays to the ink droplet within the certain duration after the landing of the ink droplet. It has been found as a result of investigation on the duration from the landing of the ink droplet to the irradiation of ultraviolet rays that the image with a desired uniform and high quality can be obtained when the duration is from 0.001 to 0.4 seconds, preferably from 0.005 to 0.2 seconds.

Incidentally, the time interval after an ink drop is jetted from the jet opening 4*b* of the head 4 until it is irradiated by the neighboring UV light source located at the rear side of the head in its moving direction is controlled to be 0.001 second to 0.4 second, and desirably 0.005 second to 0.2 second. Incidentally, irradiation means in the present specification as the irradiation of rays having the illuminance of not less than 0.1 mW/cm2. Wherein, the illuminance is defined as the illuminance measured by the Spectroradiometer USR-40 (made by USHIO INC.) at wavelength of 220–450 nm.

In this case, because the heads 4 and the UV light sources are arranged alternately at equal intervals, by the controlling of the moving speed of the carriage 3, it is possible to control the time interval from the jetting to the irradiation to become the same for all the heads 4. Besides, the time interval after an ink drop is jetted from the jet opening 4*b* of the head 4 until it is irradiated by ultraviolet rays from the neighboring UV light source 5 accompanied by the movement of the carriage 3 falls within a specified range of time for the jet openings 4*b* of any head 4. In addition, "landing" of an ink drop means the moment when the ink drop becomes in contact with the recording medium 99 and the timing is defined as landing timing.

In the case where an ink is jetted on a plastic film having a non-absorption property such as a PET film, with the passage of time not shorter than a certain time in the state of not being hardened after the landing, the blur of ink drops becomes larger, which degrades the image quality. In order to obtain a uniform and high-quality image to cope with the variety of recording media, it is desirable to carry out light irradiation for the ink drops within a definite time after landing to harden the ink. Therefore, the time interval from the landing of an ink drop to the light irradiation was investigated; as the result, it was found that so long as the time interval came within a range of 0.0001 second to 0.4 second, and desirably 0.005 second to 0.2 second, a uniform and high-quality image could be obtained for any recording medium used.

The ink jet printer 1, after having carried out several times suitably the forward and backward movement of the carriage 3, the jetting of ink drops, and the irradiation of the ink drops, transports the recording medium 99 by a specified distance in the sub-scanning direction by the transport mechanism. Then, when the recording medium is again stopped, the ink jet printer 1 again carries out the forward movement or the backward movement of the carriage 3, the jetting of ink drops, and the irradiation for the ink drops. After this, by the ink jet printer 1 repeating the above-mentioned operation, an image is formed on the recording medium 99. In addition, because the UV light sources 5 are covered with the shading cover 9, it never occurs that the ink drops jetted from the heads 4 are hardened before they are landed on the recording medium 99, and on top of it, also it never occurs that some amount of UV ink remaining at the jet openings 4*b* of the heads 4 is hardened.

In the ink jet printer 1, the intervals between two neighboring heads 4 and 4 are all the same, the interval between two neighboring UV light sources 5 and 5 are all the same, and the heads 4 and the UV sources 5 are arranged alternately in a straight line in the main scanning direction A, and further, the carriage 3 makes a constant-speed movement within the image formation range. Hence, the time interval after an ink drop jetted from the head 4 is landed on the recording medium 99 until ultraviolet rays are emitted from the UV light source 5 neighboring the head 4 (in FIG. 2, assuming that the carriage 3 is moving right, the UV light source 5 adjacent to the left side of the head 4 concerned) is the same for any ink drop jetted from any head 4. In other words, assuming that the carriage 3 is moving right for example, to explain it with reference to FIG. 2, the time interval after an ink drop jetted from the rightmost head 4 (the head 4 for jetting a UV ink drop of yellow) is landed on the recording medium 99 until it is irradiated by the UV light source 5 adjacent to the left side of the head 4 concerned, is equal to the time interval after an ink drop jetted from the leftmost head 4 (the head 4 for jetting a UV ink drop of light black) is landed on the recording medium 99 until it is irradiated by the UV light source 5 adjacent to the left side of the head 4 concerned. This term "is equal to" means "is within a specified deviation of time from".

Hence, for an ink drop jetted, from whichever head 4 it is jetted, the time interval from the landing to the irradiation by ultraviolet rays is approximately equal to a definite value, and time required for hardening is constant. Hence, for an ink drop jetted, from whichever head 4 it is jetted, the degree of spreading, that is, the degree of blur is approximately the same.

Further, to remark any one head 4, because the jet openings 4*b*, 4*b*, - - - are arrayed in a straight line in the sub-scanning direction and in parallel with the neighboring UV light source 5, for an ink drop jetted, from whichever jet opening 4*b* it is jetted, the time interval from the landing to the irradiation by ultraviolet rays has a definite value, and the time required for hardening has a definite value. Hence, for an ink drop jetted, from whichever jet opening 4*b* it is jetted, the degree of spreading, that is, the degree of blur is approximately the same. In other words, in the case where the jet openings 4*b*, 4*b*, - - - are arrayed as the head 4 shown in FIG. 3, and the heads 4, 4, - - - are arranged as shown in FIG. 2, the degree of blur becomes the same for all the dots (ink drops) in an image formed by the ink drops jetted form the jet openings 4*b*, 4*b*, - - - ; therefore, the quality of the image is stable.

Figure 9:
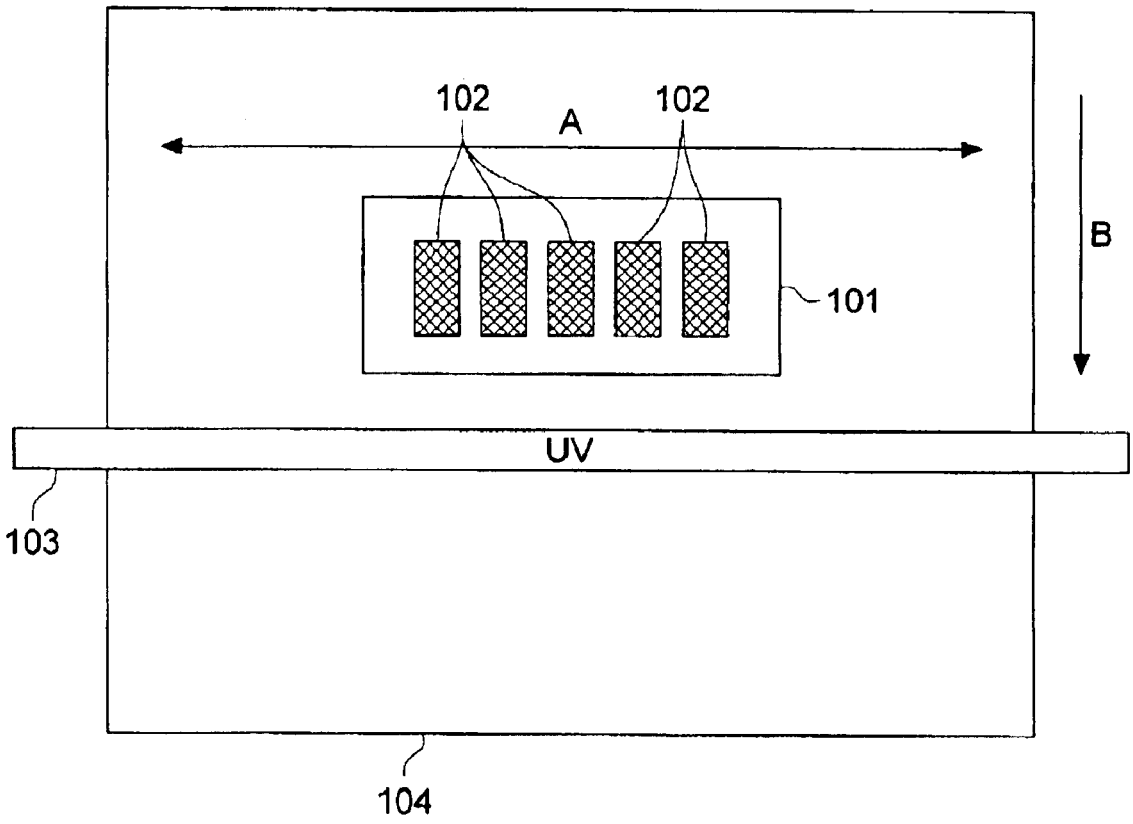
FIG. 9 is the plan showing the essential part of a conventional ink jet printer.

Further, because the UV light sources 5, 5, - - - and the heads 4, 4, - - - are alternately arranged in the main scanning direction A, an ink drop landed, from whichever head 4 it has been jetted, is immediately irradiated by the ultraviolet rays emitted from the UV light source 5 adjacent to the head 4. In the above, the term "immediately" means "sooner" compared to conventional examples as shown in FIG. 9. Hence, because any ink drop jetted from any head 4 is hardened comparatively quickly after it is landed on a recording medium, it does not spread on the recording medium 99; thus, what is called a blur is prevented. Hence, by the ink jet printer 1, a very high-quality image can be formed.

In addition, this invention is not to be limited to the above-mentioned examples of the embodiment, and within the scope not departing from the spirit of this invention, it is also appropriate to practice various kinds of improvement and modification of design.

For example, in the above-mentioned examples of the embodiment, there is one line composed of the plural heads 4, 4, - - - between two neighboring UV light sources 5 and 5; however, it is also possible to provide a plurality of lines of heads in the main scanning direction A between two neighboring UV sources (for example, it is also possible to provide a plurality of heads in a matrix-type arrangement on the carriage), and also in this case, in each line, UV light sources and heads are arranged alternately, or they are arranged in such a way that one line of UV light sources are disposed at every certain plural number of heads (lines of heads). Further, it is also possible that UV light sources in each line are such ones as to be common to all the lines.

Figure 4:
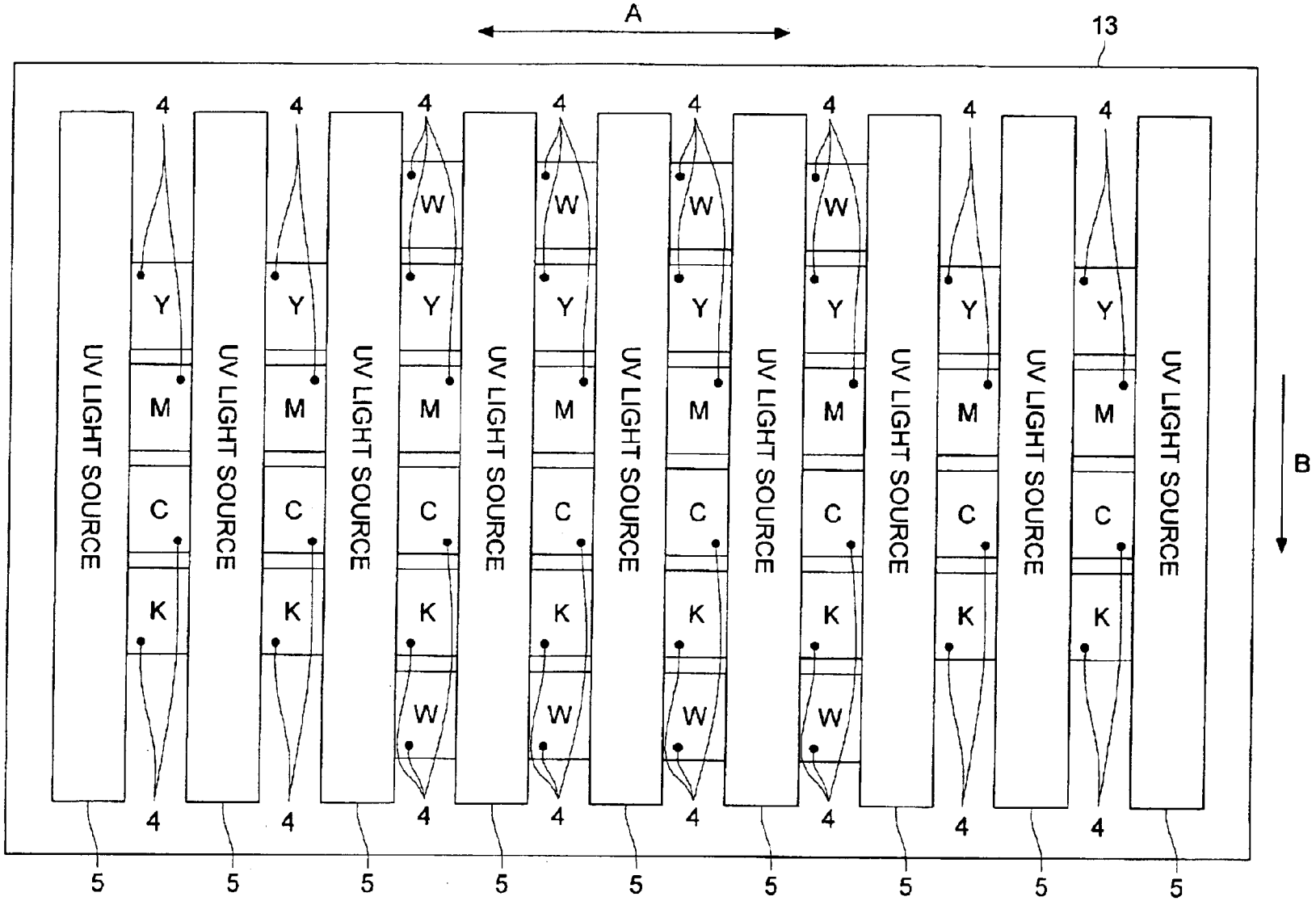
FIG. 4 is the bottom view showing as an outline a carriage of an example other than the above-mentioned carriage.

For example, it is also possible to provide a carriage 13 shown in FIG. 4 instead of the carriage 3 of the ink jet printer 1 shown in FIG. 1. On the carriage 13, it is also possible that a plurality of heads 4, 4, - - - are disposed approximately in a matrix-type arrangement.

[First line] Four heads 4 for jetting UV ink drops of white are arranged in a line in the main scanning direction A.

[Second line] Eight heads 4 for jetting UV ink drops of yellow are arranged in a line in the main scanning direction A.

[Third line] Eight heads 4 for jetting UV ink drops of magenta are arranged in a line in the main scanning direction A.

[Fourth line] Eight heads 4 for jetting UV ink drops of cyan are arranged in a line in the main scanning direction A.

[Fifth line] Eight heads 4 for jetting UV ink drops of black are arranged in a line in the main scanning direction A.

[Sixth line] Four heads 4 for jetting UV ink drops of white are arranged in a line in the main scanning direction A.

In any one of the first to sixth lines, the heads 4 and the UV light sources 5 are arrayed alternately in the main scanning direction A, and for the purpose of making a forward-and-backward scanning, a UV light source 5 is provided at each of both the end positions in the main scanning direction A. Further, the UV light sources 5 are used in common to the heads of white, yellow, magenta, cyan, and black.

Further, in the above-mentioned examples of the embodiment, UV inks are employed for the active-ray-setting inks, but the active-ray-setting inks are not limited to UV inks, and for example, it is also appropriate to employ electron-ray-setting inks for the active-ray-setting inks. In the case of irradiation by electron rays, it is known that polymerization of a monomer (an oligomer) does not need a photochemical catalyst such as a photochemical reaction initiator, and proceeds through a radical reaction. Therefore, for the electron-ray-setting inks, ones including a pigment and a monomer (an oligomer) but no photochemical reaction initiator of a high price can be applied. Owing to this, a high-precision high-strength image can be formed at a lower cost on the recording medium 99. It is a matter of course that, in the case where electron-ray-setting inks are used, electron ray sources for emitting electron rays towards the recording medium 99 are provided on the carriage 3 or the carriage 13 instead of the UV light sources 5.

Figure 5:
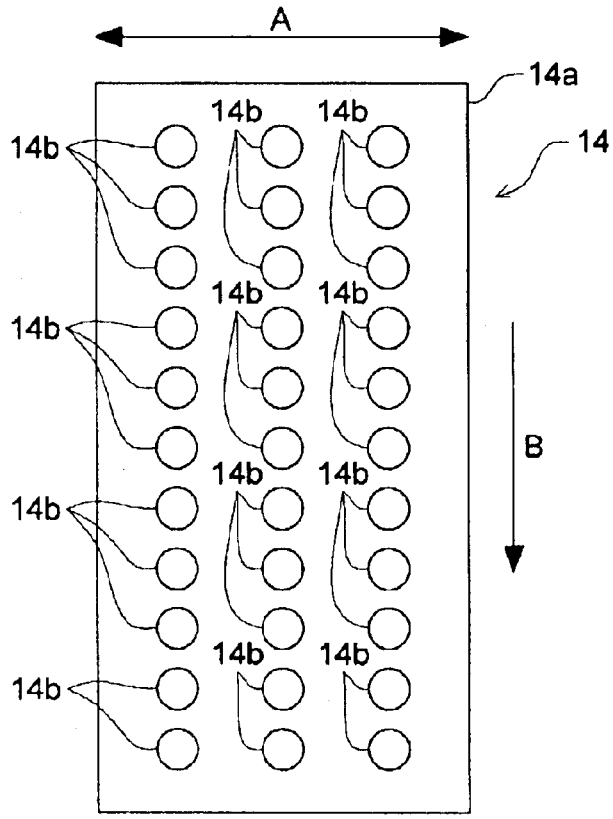
FIGS. 5(*a*) and 5(*b*) are drawings showing as an outline a head of an example other than the above-mentioned head.
Figure 5:
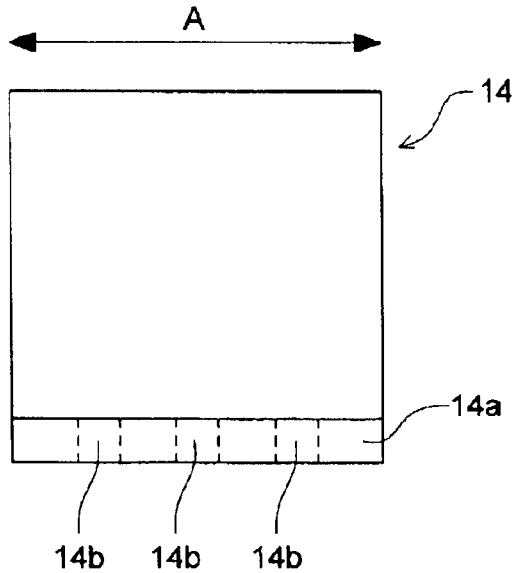

Further, in the above-mentioned examples of the embodiment, in the head 4, jet openings 4*b* are arrayed in a straight line in the sub-scanning direction B; however, it is also possible to make the head such one as to have a plurality of lines of jet openings arranged in a straight line in the sub-scanning direction B, or also it is possible to provide a plurality of heads having a single line of jet openings. For example, it is also appropriate to provide a head 14 as shown in FIG. 5 in the carriage 3 or in the carriage 13 instead of the head 4. In this head 14, there is provided a nozzle plate 14*a* making up the bottom of this head 14. In the nozzle plate 14*a*, there are formed a plurality of jet openings 14*b*, 14*b*, - - - leading from the internal space of the head 14 to the outside of the head 14. Further, the plural jet openings 14*b*, 14*b*, - - - are arranged in three lines parallel to the sub-scanning direction B in the nozzle plate 14*a*. Of course, ink drops are jetted from each jet opening 14*b*. Further, also in the case of the head 14 where the jet openings 14*b*, 14*b*, - - - are arranged in three lines as shown in FIG. 5, to remark a certain jet opening 14*b*, the head 14 is disposed at a position such that the time interval until an ink drop is irradiated by the ultraviolet rays from the UV light source 5 adjacent to the left side of it is equal to the time interval until an ink drop is irradiated by the ultraviolet rays from the UV light source 5 adjacent to the right side of it in a reverse-direction scanning, or these time intervals are both fall within a specified range of time. In addition, FIG. 5(*a*) is the bottom view of the head 14, and FIG. 5(*b*) is the front view showing the head 14 as seen in the sub-scanning direction B.

Figure 6:
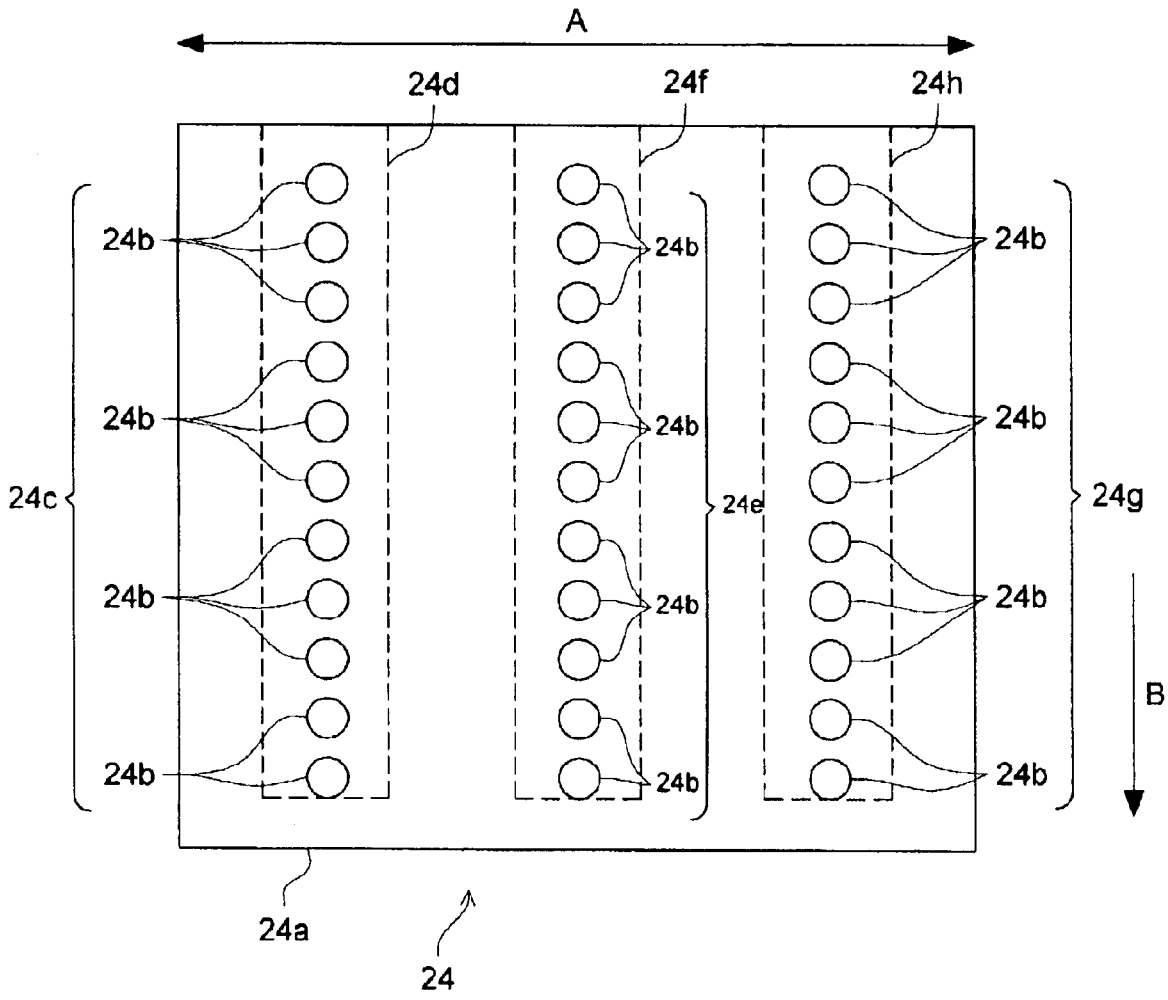
FIG. 6 is the bottom view showing as an outline a head of an example other than the above-mentioned heads.

Further, in the above-mentioned examples of the embodiment, the color of the UV ink drops jetted from the jet openings 4*b* provided in one head 4 is the same for all the jet openings, but also it is possible to make ink drops jetted from one or some jet openings have a color different from the color of ink drops jetted from other jet openings. For example, a head 24 is provided in the carriage 3 or in the carriage 13 instead of the head 4, and in this head 24, the colors of UV ink drops jetted are classified by line. FIG. 6 is the bottom view of the head 24.

In the bottom plate of the head 24, in about the same way as the head 14, a plurality of jet openings 24*b*, 24*b*, - - - are formed. Further, three lines of jet openings, each line being composed of plural jet openings 24*b*, 24*b*, - - - arranged in a straight line in the sub-scanning direction B, are arranged on the bottom surface of the head 24. Each of the jet openings 24*b* in the left line 24*c* shown in FIG. 6 leads to a supply path 24*d* extending through the inside of the head 24, each of the jet openings 24*b* in the central line 24*e* leads to a supply path 24*f* extending through the inside of the head 24, and each of the jet openings 24*b* in the right line 24*g* leads to a supply path 24*h* extending through the inside of the head 24. Further, the supply paths 24*d*, 24*f*, and 24*h* lead to the ink tanks 6 of different ink colors respectively. Hence, the color of the UV ink drops jetted from the jet openings 24*b* of the left line 24*c*, the color of the UV ink drops jetted from the jet openings 24*b* of the central line 24*e*, and the color of the UV ink drops jetted from the jet openings 24*b* of the right line 24*g* are different from one another. What makes up the bottom of the head 24 is the nozzle plate 24*a*.

Further, in the above-mentioned examples of the embodiment, ink drops are jetted while the carriage 3 or the carriage 13 is moving left in the image formation range shown in FIG. 1 and also while the carriage is moving right; however, it is also possible to jet ink drops only during the moving of the carriage in one direction. In this case, assuming that ink drops are jetted only while the carriage 3 or the carriage 13 is moving left, it is unnecessary to provide the leftmost UV light source 5, and in the case where ink drops are jetted only while the carriage 3 or the carriage 13 is moving right, it is unnecessary to provide the rightmost UV light source 5.

Further, in the above-mentioned examples of the embodiment, the heads 4 (the heads 14, or the heads 24) and the UV light sources are alternately arranged in the main scanning direction A; however, it is also possible to arrange the UV light sources and the lines of jet openings in the main scanning direction in a head. For example, the head shown in FIGS. 7(*a*) and 7(*b*) are examples of it. In addition, in FIGS. 7(*a*) and 7(*b*), the direction perpendicular to the depth direction with respect to the paper surface in the drawing is the sub-scanning direction B.

Figure 7:
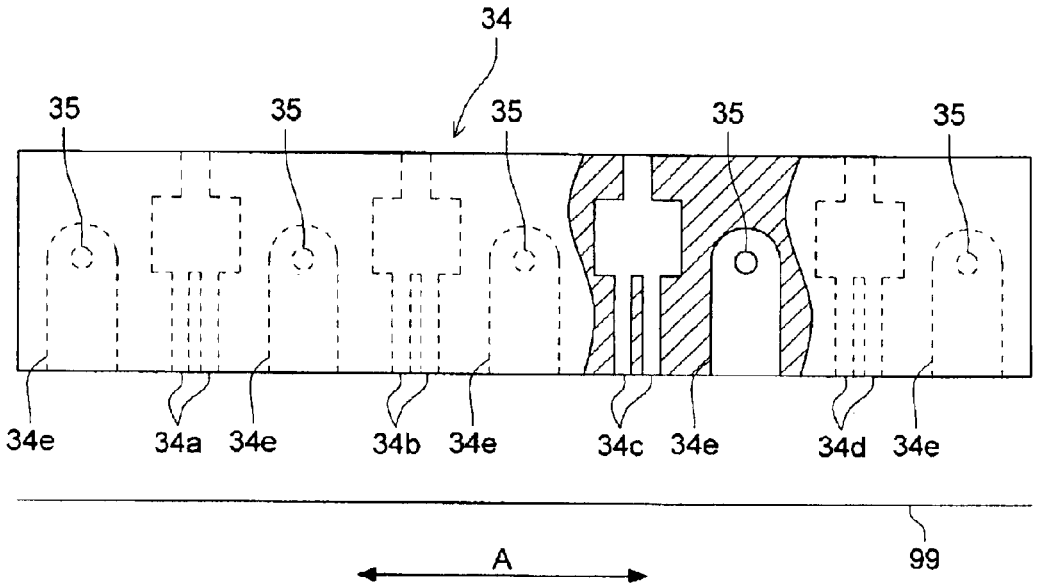
FIGS. 7(*a*) and 7(*b*) are the front views showing a head of an example other than the above-mentioned heads as an outline, and in FIG. 7(*a*) and FIG. 7(*b*), a part of the head is shown in an exploded way.
Figure 7:
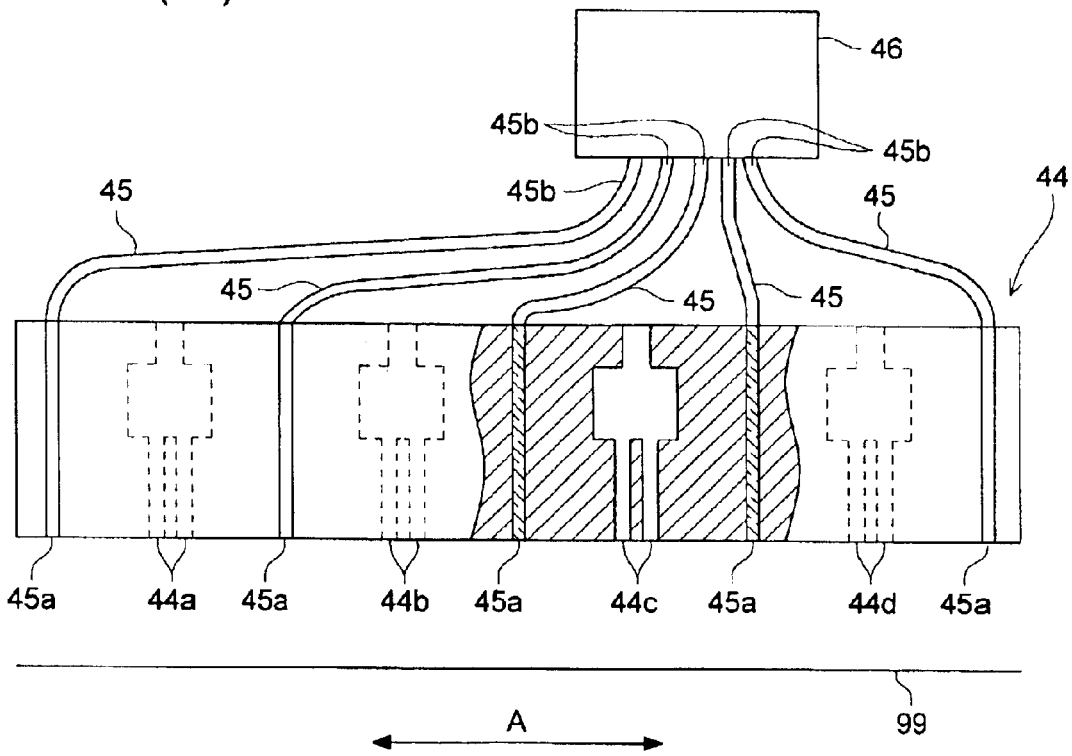

At the bottom of a head 34 shown in FIG. 7(*a*), in the order from left to right, there are provided jet openings for jetting ink drops of yellow 34*a*, 34*a*, - - - , jet openings for jetting ink drops of magenta 34*b*, 34*b*, - - - , jet openings for jetting ink drops of cyan 34*c*, 34*c*, - - - , and jet openings for jetting ink drops of black 34*d*, 34*d*, - - - . As regards the jet openings 34*a*, 34*b*, 34*c*, and 34*d*, a plurality of them for each color are arranged in a line in the depth direction with respect to the paper surface of the drawing, that is, in the sub-scanning direction.

Further, as shown in FIG. 7(*a*), on the bottom surface of the head 34, a plurality of concave portions 34*e*, 34*e*, - - - are formed at equal intervals. Each of the concave portions 34*e*, as seen from the bottom side, has the longer dimension in the sub-scanning direction B, and is longer than the length of the lines of jet openings 34*a*, 34*b*, 34*c*, and 34*d* in the sub-scanning direction B. In each of the places between the neighboring concave portions 34*e*, any one of the line of jet openings 34*a*, the line of jet openings 34*b*, the line of jet openings 34*c*, and the line of jet openings 34*d* is disposed. In each of the concave portions 34*e*, there is provided a UV light source 35 for emitting ultraviolet rays. The length of the UV light source 35 in the longer dimension is approximately equal to or longer than the length of the lines of jet openings 34*a*, the length of the lines of jet openings 34*b*, the length of the lines of jet openings 34*c*, or the length of the lines of jet openings 34*d*.

This head 34 is provided on the carriage 3 shown in FIG. 1, or attached to the guide member 2 shown in FIG. 1 in a movable way along the guide member 2. Hence, the head 34 is made to move back and forth in the main scanning direction A.

At the bottom of the head 44 shown in FIG. 7(*b*), in the order from left to right, there are provided jet openings for jetting ink drops of yellow 44*a*, 44*a*, - - - , jet openings for jetting ink drops of magenta 44*b*, 44*b*, - - - , jet openings for jetting ink drops of cyan 44*c*, 44*c*, - - - , and jet openings for jetting ink drops of black 44*d*, 44*d*, - - - . As regards the lines of jet openings 34*a*, 34*b*, 34*c*, and 34*c*, a plurality of them for each color are arranged in a line in the depth direction with respect to the paper surface of the drawing, that is, in the sub-scanning direction.

This head 44 is provided on the carriage 3 shown in FIG. 1, or attached to the guide member 2 shown in FIG. 1 in a movable way along the guide member 2. Hence, the head 44 is made to move back and forth in the main scanning direction A.

To this head 44, flexible optical fibers 45, 45, - - - are coupled. One end 45*b* of each optical fiber 45 is connected to the light emitting part 46 for emitting ultraviolet rays, and the other end 45*a* of each optical fiber 45 comes to the bottom surface of the head 44. The other end 45*a* of each optical fiber 45, as seen from the lower side, has the longer dimension in the sub-scanning direction B, and is longer than the length of the line of jet openings 44*a*, 44*b*, 44*c*, or 44*d* in the sub-scanning direction B. At the positions between the neighboring other ends of the optical fibers 45, the line of jet openings 44*a*, the line of jet openings 44*b*, the line of jet openings 44*c*, and the line of jet openings 44*d* are disposed respectively. In this head 44, ink drops jetted onto the recording medium 99 are irradiated by ultraviolet rays, which are emitted from the light emitting part 46, transmitted through the optical fiber 45, and emerge from the other end 45*a*. In addition, in this case, the term "the active ray source" used in this invention stands for the other end 45*a* of the optical fiber 45.

As another example of practice, a line-type ink jet printer using a line-type head arranged in the direction (main scanning direction) approximately perpendicular to the transporting direction of a recording medium (sub-scanning direction). As regards the detail of it, explanations overlapping the examples of practice explained in the foregoing will be omitted, and only the parts different from the foregoing examples of practice will be explained.

Figure 8:
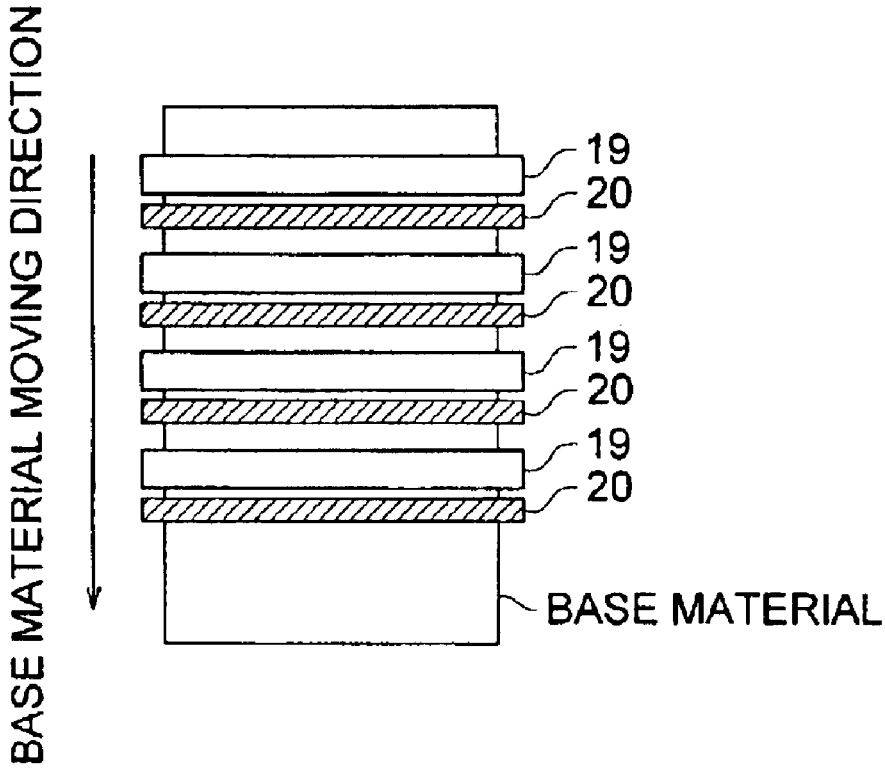
FIG. 8 is an outline drawing of an ink jet printer having a line-type head.

FIG. 8 is a structural drawing in outline of a line-type ink jet printer having line-type heads with emission sources of active rays arranged. In FIG. 8, 19 denotes line heads, and 20 denotes UV light sources. The line heads and the UV light sources are arranged alternately in the transporting direction of a recording medium, and arranged in such a way that each of the printing and the irradiation is done in a multistage way. The recording medium is transported in the direction approximately perpendicular to the array direction of the jet openings of the line-type head. The line heads 19 and the UV light sources 20 are both arranged at equal intervals. Ink drops of an UV ink jetted from each of the line heads 19 and landed on the recording medium are irradiated immediately after the landing by the ultraviolet rays from each of the UV light sources 20 disposed next to the line head 19 at the downstream side in the transporting direction of the recording medium. Owing to this, ink drops, from whichever line head 19 they are jetted, are immediately irradiated by the ultraviolet rays, therefore, the time interval up to the hardening of the ink drops are shortened, and the spreading of ink drops on the recording medium can be suppressed.

In this case, the recording medium 99 is continuously conveyed, not intermittently such as that in the first embodiment. The recording medium 99 is preferably conveyed in a constant speed by the conveying mechanism. The duration of from the landing of each of the inks ejected from each of the line heads 64 to the beginning of irradiation by the UV ray source adjacently provided at the lower course of the sub-scanning direction B, is controlled so that the duration is to be within the range of from 0.001 to 0.4 seconds, preferably from 0.005 to 0.2 seconds. In such the case, the duration of from the landing of the ink droplet to the beginning of irradiation can be controlled by controlling the conveying speed of the recording medium 99 with respect to each of the line heads since the line head 64 and the UV ray source are alternatively arranged at the same intervals.

Further, any ink drop jetted from any line head has little deviation of the time interval from its landing to the irradiation from a definite value, and the time interval until ink drops start setting becomes constant; therefore, there is no difference in the degree of spreading of ink drops among the line heads.

According to this invention, because each of a plurality of active ray sources and each of a plurality of heads are alternately arranged in the main scanning direction, an ink drop landed, from whichever head it has been jetted, is immediately irradiated by ultraviolet rays from the active ray source adjacent to the head. Compared to conventional examples, even in the case there are a plurality of lines of jet openings in a head, and in either case of forward movement and backward movement, because the timing when an ink drop is subjected to the irradiation by the active ray source located at the downstream side in the moving direction during operation falls within a specified range of time, the degree of blur is equalized, and the degree of color mixing is also equalized; therefore, it becomes possible to provide a high-quality image formation. Hence, an ink drop jetted from any one of heads is hardened sooner compared to conventional examples after it is landed on a recording medium; therefore it does not spread on the recording medium, and what is called a blur is reduced and equalized. Thus, this invention exhibits an effect to make it possible to obtain a high quality image.

Further, because each plurality of active ray sources and each of a plurality of heads are alternately arranged in the main scanning direction, for an ink drop jetted, from whichever head it has been jetted, the time period from the landing to the irradiation becomes constant, and the time required for setting is constant. Hence, as regards an ink drop landed, from whichever head it has been jetted, the degree of its spreading, that is, the degree of the blur becomes the same. Hence, this invention exhibits an effect to make it possible to obtain a higher-quality image.

What is claimed is:

1. An ink jet printer comprising:

a plurality of heads, each of the plurality of heads having a plurality of jet openings for jetting an active-ray-setting ink as ink drops towards a recording medium; and a plurality of active ray sources to irradiate active rays for hardening the ink drops of the active-ray-setting ink on the recording medium, wherein each of the plurality of heads and each of the plurality of active ray sources are arranged alternately, and wherein a time interval from a landing of an ink drop, which is jetted from any one of the plurality of heads, to a first irradiation of the ink drop by active rays from any one of the plurality of active ray sources falls within a range of 0.001 second to 0.4 second.

2. The ink jet printer of claim 1, wherein the time interval from the landing of an ink drop, which is jetted from any one of the plurality of heads, to the first irradiation of the ink drop by active rays from any one of the plurality of active ray sources falls within a range of 0.005 second to 0.2 second.

3. An ink jet printer comprising:

a plurality of heads, each of the plurality of heads having a plurality of jet openings for jetting an active-ray-setting ink as ink drops towards a recording medium;

a plurality of active ray sources to irradiate active rays for hardening the ink drops of the active-ray-setting ink on the recording medium; and a mobile body which is movable in a main scanning direction relatively to the recording medium, and which is provided with the plurality of heads and the plurality of active ray sources in such a way that each of the plurality of heads and each of the plurality of active ray sources are arranged alternately in the main scanning direction.

4. The ink jet printer of claim 3, wherein the plurality of jet openings are formed linearly along a sub-scanning direction which is substantially perpendicular to the main scanning direction.

5. The ink jet printer of claim 3, wherein intervals between each of the plurality of heads and each of the active ray sources neighboring said each of the plurality of heads are equal.

6. The ink jet printer of claim 3, wherein:

the plurality of active ray sources are arranged in such a way that intervals between any of two neighboring active ray sources are equal, the plurality of heads are arranged in such a way that the intervals between any of two neighboring heads are equal, and the mobile body is controlled to move at a constant speed in a range of image formation.

7. The ink jet printer of claim 3, wherein the ink jet printer is controlled to jet ink drops from the jet openings and to emit the active rays from the plurality of active ray sources, during a movement of the mobile body.

8. The ink jet printer of claim 3, wherein a time interval from a landing of an ink drop, which is jetted from any one of the plurality of heads, to a first irradiation of the ink drop by active rays by any one of the plurality of active ray sources falls within a specified range of time.

9. The ink jet printer of claim 3, wherein the plurality of heads comprise heads for forming a full color image.

10. An ink jet printer comprising:

a plurality of heads, each of the plurality of heads having a plurality of jet openings for jetting an active-ray-setting ink as ink drops towards a recording medium; and a plurality of active ray sources to irradiate active rays for hardening the ink drops of the active-ray-setting ink on the recording medium, wherein the plurality of heads and the plurality of active ray sources move relatively to the recording medium in a sub-scanning direction, and each of the plurality of heads and each of the plurality of active ray sources are arranged alternately in the sub-scanning direction.

11. The ink jet printer of claim 10, wherein the plurality of jet openings are formed linearly along a main scanning direction, which is substantially perpendicular to the sub-scanning direction.

12. The ink jet printer of claim 10, wherein intervals between each of the plurality of heads and each of the active ray sources neighboring said each of the plurality of heads are equal.

13. The ink jet printer of claim 10, wherein:

the plurality of active ray sources are arranged in such a way that intervals between any of two neighboring active ray sources are equal, and the plurality of heads are arranged in such a way that intervals between any of two neighboring heads are equal.

14. An ink jet printer comprising:

a plurality of heads, each of the plurality of heads having a plurality of jet openings for jetting an active-ray-setting ink as ink drops towards a recording medium;

a plurality of active ray sources to irradiate active rays for hardening the ink drops of the active-ray-setting ink on the recording medium; and a transporting mechanism for transporting the recording medium in a sub-scanning direction, wherein each of the plurality of heads and each of the plurality of active ray sources are arranged alternately.

15. An ink jet printer for forming an image on a recording medium with an active-ray-setting ink, which is hardened by an irradiation of active rays, comprising:

a mobile body movable in a main scanning direction relatively to the recording medium;

an active ray source provided on the mobile body for irradiating the active rays to the recording medium; and a plurality of lines of jet openings, each line of the plurality of lines of jet openings having a plurality of jet openings, for jetting the active-ray-setting ink as ink drops towards the recording medium, wherein the plurality of lines of jet openings are arranged at both sides of the active ray source in the main scanning direction.

16. An ink jet head unit comprising:

a plurality of lines of jet openings for jetting an active-ray-setting ink as ink drops, wherein each line of the plurality of lines of jet openings includes a plurality of jet openings arranged linearly on different lines respectively; and an active ray source provided between said plurality of lines of jet openings for emitting active rays for hardening the active-ray-setting ink.

* * * * *